United States Patent [19]

Wood

[11] 4,308,950

[45] Jan. 5, 1982

[54] ARTICLE CARRIER

[75] Inventor: Prentice J. Wood, Hapeville, Ga.

[73] Assignee: The Mead Corporation, Dayton, Ohio

[21] Appl. No.: 150,991

[22] Filed: May 19, 1980

[51] Int. Cl.[3] ..... B65D 5/48

[52] U.S. Cl. ..... 206/188; 206/189; 229/28 BC; 229/52 BC

[58] Field of Search ..... 206/175, 188, 193, 200, 206/147, 156, 157, 185, 189, 190, 191, 183, 162–166, 170; 229/28 BC, 52 BC, 89

[56] References Cited

U.S. PATENT DOCUMENTS 3,568,880 3/1971 Harrelson ..... 206/188

4,240,545 12/1980 Stout ..... 206/188

*Primary Examiner*—Joseph Man-Fu Moy

*Attorney, Agent, or Firm*—Rodgers & Rodgers

[57] ABSTRACT

An article carrier of the so-called basket style includes a bottom panel to the side edges of which side walls are foldably joined, end panels foldably joined to the end edges of the side walls with riser panels foldably joined to the inner edges of the end wall panels and secured together in flat face contacting relation, a multi-ply handle panel connected at its ends with the upper ends of the riser panels, a medial keel panel integrally formed with each riser panel at one end of the carrier and arranged to project inwardly, transverse partition structure arranged to cooperate with the keel panel so as to provide transverse reinforcement for the side walls, such reinforcing structure including at least one transverse partition panel on each side of the carrier arranged with the outer ends thereof anchored to the associated side wall and with the inner ends anchored to one of the keel panels, and a reinforcing tab foldably joined to one of the keel panels and secured in overlapping face contacting relation with the transverse partition panel whose inner edge is anchored to the other keel panel so that the inner ends of the transverse partition panels are effectively and snugly coupled together thereby to prevent outward bowing of the side walls of the carrier.

12 Claims, 7 Drawing Figures

ARTICLE CARRIER

TECHNICAL FIELD

This invention relates to article carriers of the so-called basket style which are of the full protection type wherein partition structure is provided on all sides of the packaged articles.

BACKGROUND ART

Carriers of the general type to which this invention is applicable are disclosed in U.S. Pat. Nos. 3,572,544, 3,432,073, and 3,917,060 all of which are owned by the assignee of this invention.

The cross partition panels of known carriers are frequently anchored at their outer ends to the side walls of the carrier by means of glue flaps and at their inner ends are foldably joined and thereby anchored to medial panels of the carrier. Normally such medial panels are held in face contacting relation with each other by means of adhesive. In such constructions, heavy loads and the resulting stress on the side walls tends to bow the side walls outwardly. Such stress may weaken or sever the glue bond between the medial panels resulting in unacceptable outward bowing of the side walls.

DISCLOSURE OF THE INVENTION

According to this invention in one form, basket style carriers are provided with transverse reinforcement which inhibits or prevents outward bowing of the side walls. Such structure includes at least one transverse partition panel on each side of the carrier arranged with its outer end anchored to the associated side wall and also arranged with its inner end anchored to medial keel panels disposed immediately underneath the carrier handle. In accordance with a principal feature of the invention, a reinforcing tab foldably joined to one keel panel is secured in flat face contacting relation with a transverse partition anchored to the other keel panel so that by this means two aligned partition panels are effectively coupled together at their inner ends to provide a transverse strut which limits or prevents outward bowing of the carton side walls.

BEST MODE OF CARRYING OUT THE INVENTION

Figure 1:
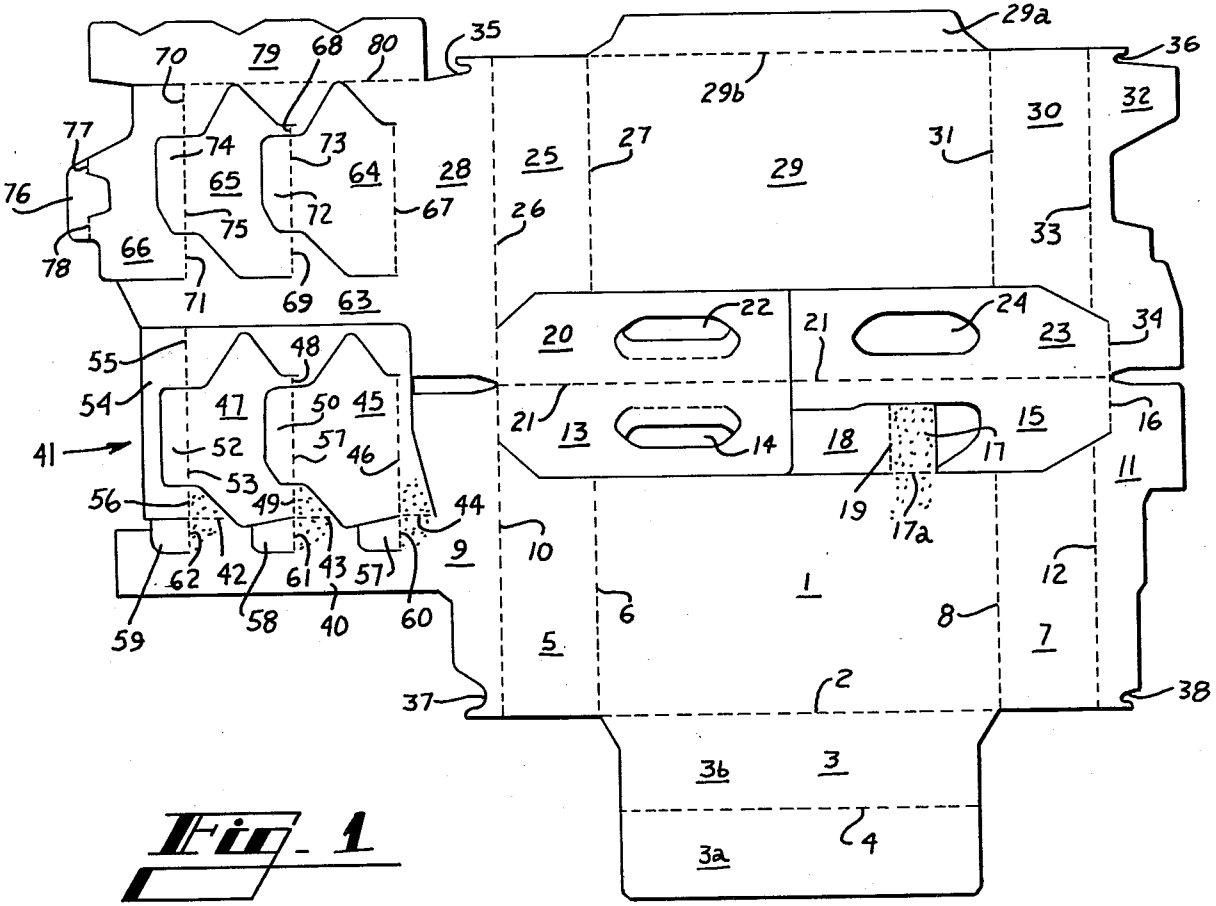
FIG. 1 is a plan view of a unitary blank formed according to this invention and which when appropriately manipulated and glued forms a carrier of the basket style.

In the drawings the numeral 1 designates a side wall to the bottom edge 2 of which a bottom panel 3 is foldably joined. Bottom panel 3 is provided with a medial fold line 4. End panel 5 is foldably joined to side wall 1 along fold line 6 while end panel 7 is foldably joined to side wall 1 along fold line 8. Riser panel 9 is foldably joined to end panel 5 along fold line 10 while riser panel 11 is foldably joined to end panel 7 along fold line 12.

The handle of the carton is of the multi-ply type and includes an outer panel 13 foldably joined to riser panel

5 along fold line 10 and having hand gripping aperture 14 formed therein. Inner handle panel 15 is foldably joined to riser panel 11 along fold line 16. An anchoring tab 17 is foldably joined to side wall 1 along fold line 17*a* and a transverse partition element 18 foldably joined to anchoring tab 17 along fold line 19.

The other side of the carrier includes outer handle panel 20 foldably joined to outer handle panel 13 along medial fold line 21. Hand gripping aperture 22 is formed in outer handle panel 20. Inner handle panel 23 is foldably joined along fold line 21 to inner handle panel 15 and hand gripping aperture 24 is formed in handle panel 23.

End panel 25 is foldably joined to outer handle panel 20 and to riser panel 28 along fold line 26 and is foldably joined along fold line 27 to one end of side wall 29. End panel 30 is foldably joined along fold line 31 to the other end of side wall 29 and riser panel 32 is foldably joined to end panel 30 along a fold line 33. Conventional locking notches 35–38 are formed respectively in riser panels 28, 32, 9 and 11.

The longitudinal and transverse partition structure for the carrier includes a medial keel panel 40 which is formed integrally with riser panel 9. Medial anchoring structure generally designated by the numeral 41 is foldably joined to medial keel panel 40 along fold lines 42, 43 and 44. Transverse partition panel 45 is foldably joined to medial anchoring structure 41 along fold line 46 while transverse partition panel 47 is foldably joined to medial anchoring structure 41 along interrupted fold lines 48 and 49. A glue flap 50 is foldably joined to the outer edge of transverse panel 45 along fold line 51 and a similar glue flap 52 is foldably joined to the outer edge of transverse panel 47 along fold line 53. Transverse panel element 54 is foldably joined to medial anchoring structure 41 along fold lines 55 and 56.

According to a main feature of this invention reinforcing tabs 57, 58 and 59 are foldably joined to medial keel panel 40 along fold lines 60, 61, and 62 respectively.

The partition structure on the other side of the carrier includes medial keel panel 63 which is integrally formed with riser panel 28 and which projects medially inward of the carrier when the carrier is set up together with transverse panels 64, 65 and 66. Transverse partition panel 64 is foldably joined to medial keel panel 63 along fold line 67 while transverse partition panel 65 is foldably joined to keel panel 63 along fold lines 68 and 69 while transverse partition panel 66 is foldably joined to medial keel panel 63 along fold lines 70 and 71. Glue flap 72 is foldably joined to transverse partition panel 64 along fold line 73 while glue flap 74 is foldably joined to transverse partition panel 65 along a fold line 75 and glue flap 76 is foldably joined to transverse partition panel 66 along fold lines 77 and 78.

Medial strut panel 79 is foldably joined to the medial keel panel 63 along fold line 80.

In order to form the carrier from the blank as depicted in FIG. 1, applications of glue are first applied to the blank as indicated by strippling in FIG. 1. Thereafter the medial anchoring structure 41 is elevated and folded forwardly along fold lines 42, 43 and 44 to occupy the position indicated in FIG. 2. This operation causes those portions of the medial anchoring structure 41 which are adjacent the fold lines 42, 43, and 44 to become adhered to those portions of medial keel panel 40 which are adjacent fold lines 42, 43, and 44. In like fashion anchoring tab 17 and transverse partition element 18 are elevated and folded forwardly to occupy the positions indicated in FIG. 2. This operation causes the anchoring panel 17 to adhere to the inner surface of the side wall 1 and the blank appears as shown in FIG. 2.

Figure 2:
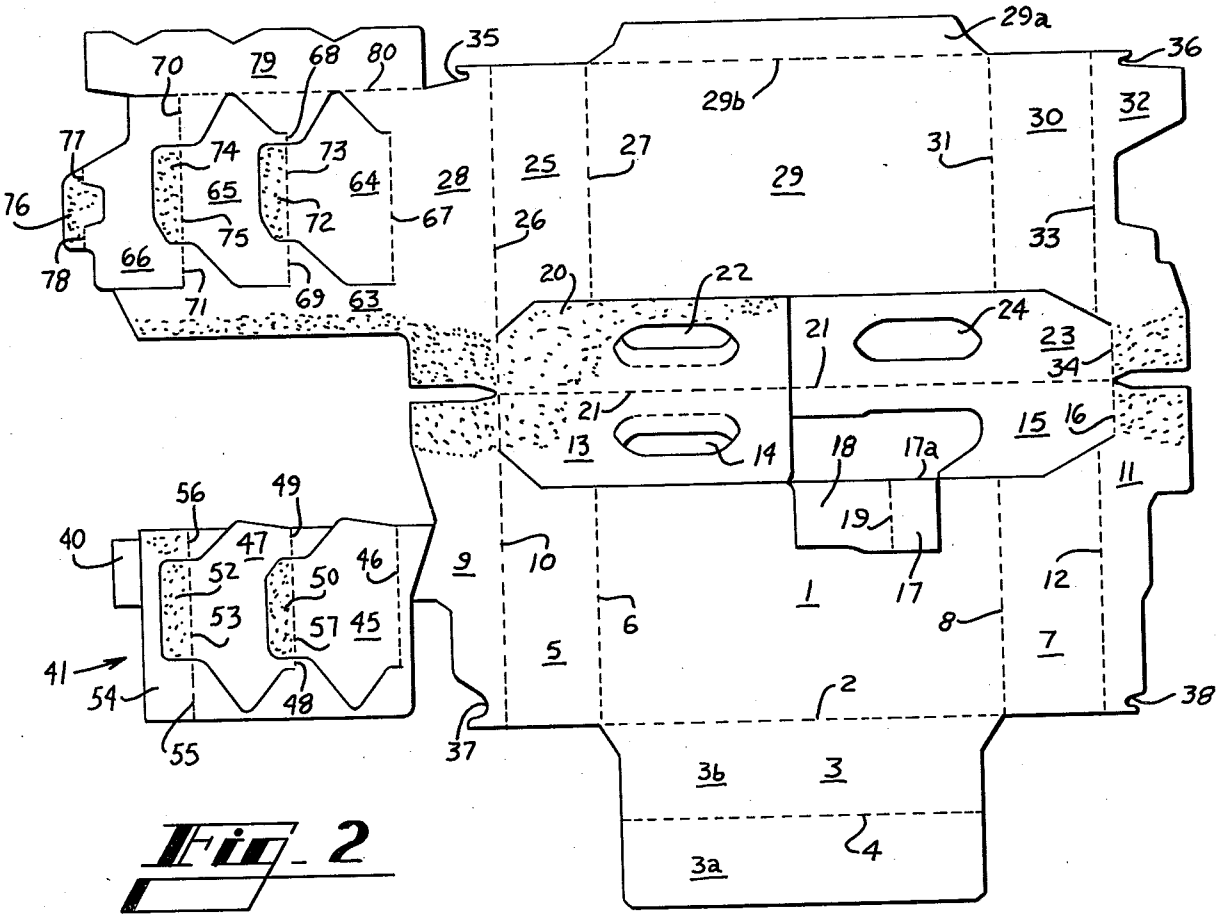
FIGS. 2, 3, 4, 5 and 6 depict folding operations through which the blank of FIG. 1 is manipulated to form the collapsed structure represented in FIG. 6
Figure 3:
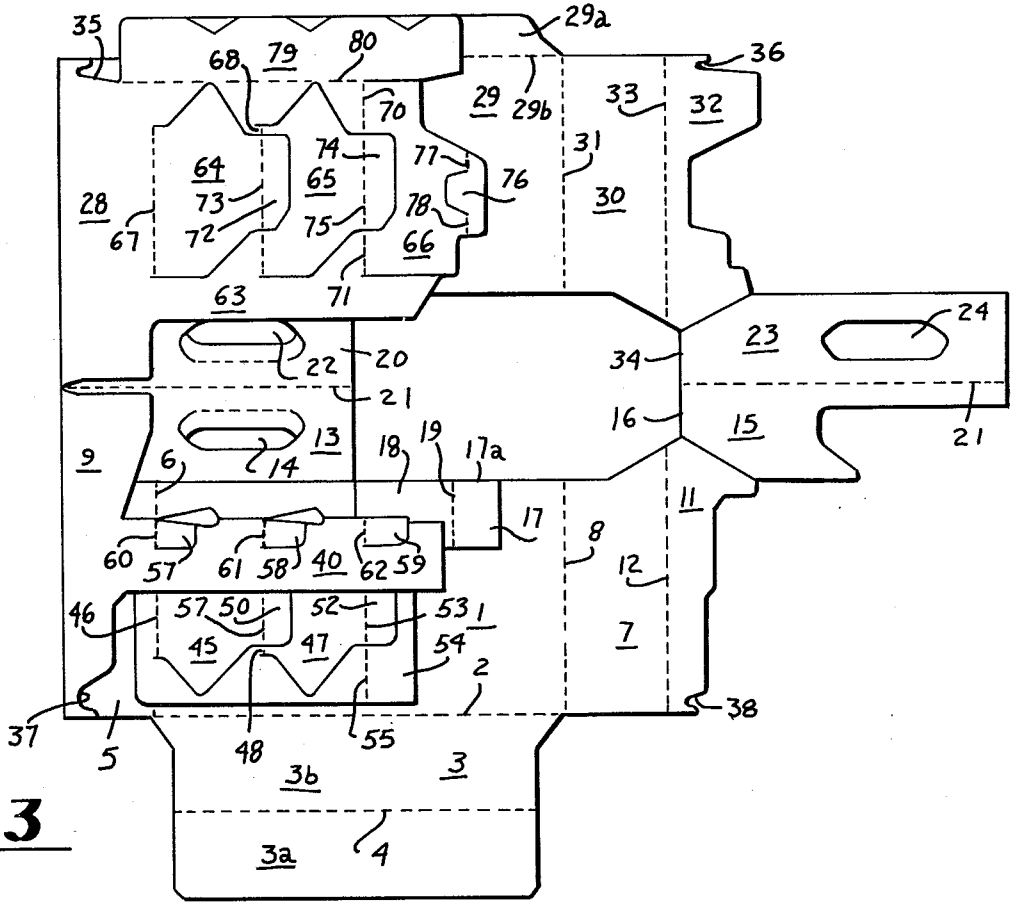

Thereafter glue is applied to riser panels 11 and 32 and inner handle panels 23 and 15 are elevated and folded toward the right along fold lines 34 and 16 to occupy the positions indicated in FIG. 3 to cause inner handle panels 23 and 15 to adhere to riser panels 32 and 11 and an application of glue is made to other parts of the blank as indicated by stippling in FIG. 2. Riser panels 9 and 28 as well as medial keel panels 40 and 63 and all the structures associated therewith including medial strut panel 79 are elevated and folded toward the right along fold lines 10 and 26. This operation causes the blank to appear as indicated in FIG. 3. After folding into the position represented by FIG. 3, riser panel 9 is adhered to the inner surface of outer handle panel 13 and glue flaps 50 and 52 are adhered to side wall 1. Simultaneously the upper end of transverse panel element 54 becomes adhered to transverse panel element 18. In similar fashion riser panel 28 and medial keel panel 63 become adhered to the inner surface of outer handle panel 20 and glue flaps 72, 74 and 76 become adhered to the inner surface of side wall 29 and the blank appears as indicated in FIG. 3.

Figure 4:
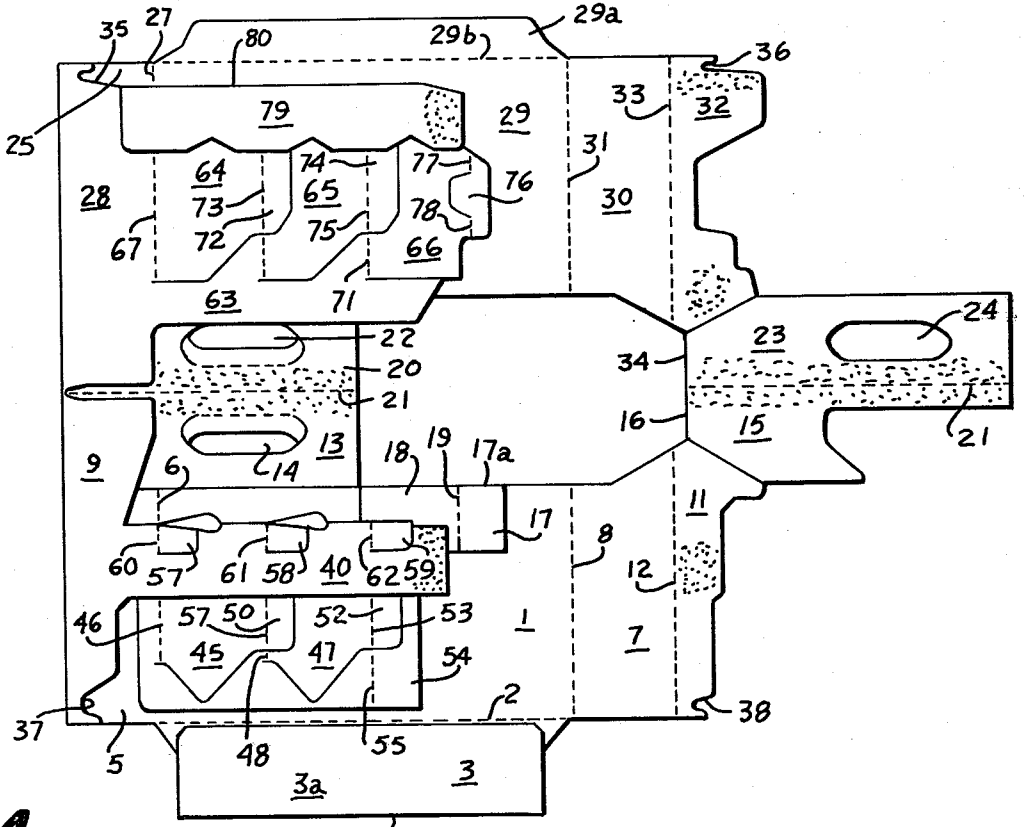

Thereafter medial strut panel 79 is folded downwardly along fold line 80 and bottom panel 3 is collapsed along its medial fold line 4 by folding the lower portion 3*a* of bottom panel 3 upwardly and into flat face contacting relation with the portion 3*b* of bottom panel 3 and the blank then appears as indicated in FIG. 4. It is obvious that transverse panel element 54 and transverse panel element 18 constitute a composite transverse panel which extends from side wall 1 to the medial strut 40 when the carrier is complete.

Figure 5:
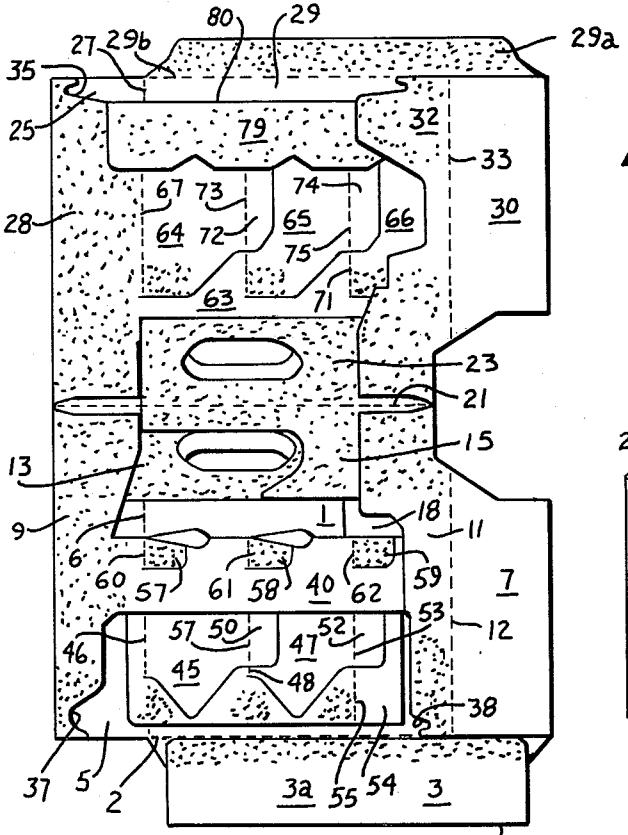

An application of glue is then made to the blank as indicated by stippling in FIG. 4 and end wall panels 7 and 30, riser panels 11 and 32 as well as inner handle panels 15 and 23 are elevated and swung toward the left along fold lines 8 and 31. Upon completion of this folding operation the blank appears as indicated in FIG. 5. The completion of this folding operation causes the riser panel 32 to adhere to the right hand end of medial strut panel 79 and to the right hand end of medial keel panel 63. In like fashion riser panel 11 is adhered to the right hand end of medial keel panel 40. Inner handle panels 15 and 23 become adhered to the inner surface of outer handle panels 13 and 20.

Figure 6:
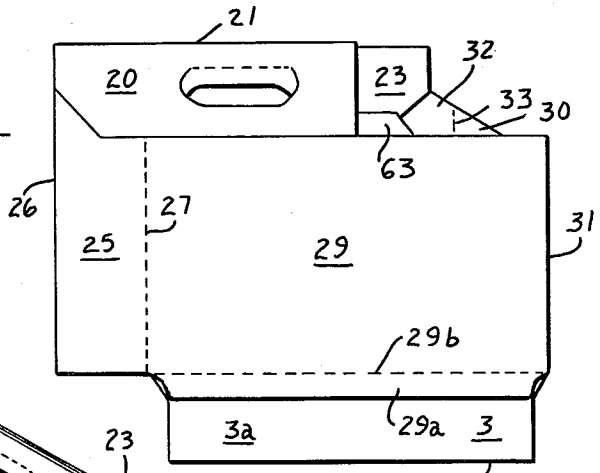

An application of glue is then made as indicated by stippling in FIG. 5 and those portions of the blank which are disposed above the medial fold line 21 are elevated and folded forwardly so that the blank then appears as indicated in FIG. 6. This latter folding operation causes riser panels 9 and 28 to become adhered to each other in face contacting relation and also causes riser panels 11 and 32 to become adhered to each other in face contacting relation. Medial strut panel 79 is adhered to the lower portions of medial anchoring structure 41 and inner handle panels 15 and 23 become adhered to each other. Lap panel 29*a* becomes adhered to bottom panel 3 and the carrier appears complete in collapsed form as indicated in FIG. 6.

This latter folding operation in accordance with this invention, causes the reinforcing tabs 57, 58 and 59 to become adhered to the portions of transverse panels 64, 65 and 66 respectively which are adjacent the fold lines 67, 75 and 78. As is apparent in FIG. 7 when the carrier is set up, reinforcing tabs 57, 58, and 59 are disposed in transverse relation relative to the carton and in flat face contacting relation with respect to transverse panels 64, 65 and 66 respectively. Since reinforcing tabs 57, 58 and 59 are foldably joined to medial keel panel 40 and since transverse panels 64, 65 and 66 are foldably joined to medial keel panel 63, which is on the opposite side of the carrier from medial keel panel 41, it is apparent that by the reinforcing tabs the medial keel panel 40 is effectively coupled to the transverse partition panels 64, 65, and 66 through the agency of reinforcing tabs 57, 58 and 59. Thus both the carton side walls 1 and 29 are effectively held against outward bowing movement due to the fact that each transverse panel such for example as 65 is anchored to side wall 29 by a glue flap such as 74 and by virtue of a reinforcing tab such as 58 which is secured to transverse panel 65 is coupled through medial keel panel 40 with transverse panel 47 which in turn is anchored by its glue flap 52 to the side wall 1. In like fashion, all of the transverse panels are coupled together and the side walls are effectively precluded from outward bowing due to the fact that what amounts to three transverse struts are provided according to this invention. The reinforcing tabs 57, 58 and 59 are secured in flat face contacting relation with the transverse panels 64, 65 and 66 so that the transverse stress of the glue connection is in shear which is quite strong compared to the face contacting securement of inner panel 23 for example to inner panel 15.

Figure 7:
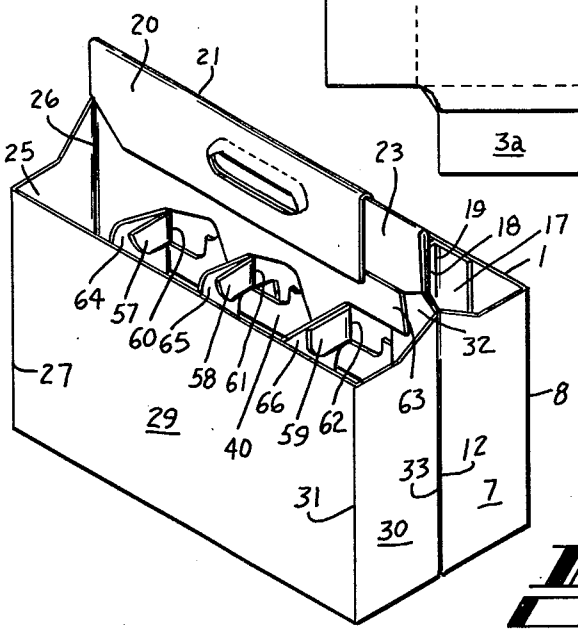
FIG. 7 is an isometric view of the completed carrier when in set-up condition.

In order to set the carrier up from the condition represented in FIG. 6 to that represented by FIG. 7, end panels 25 and 5 are held against movement toward the left and a force is applied to the right hand edges of side walls 29 and 1. This operation in known manner causes the side walls 29 and 1 to swing transversely outward and aligns the end panels 25 and 5 with each other as well as the end panels 7 and 30 with each other. Locking notches 35, 37 and 36, 38 engage the bottom panel 3 at the ends of fold line 4 and the carton remains in set up condition as represented in FIG. 7.

INDUSTRIAL APPLICABILITY

This invention is particularly applicable to basket style article carriers which are for use in packaging a plurality of heavy primary packages such as bottles and which may be subjected to substantial stress during portage.

I claim:

1. An article carrier comprising a bottom panel, opposed side walls foldably joined to opposite side edges of said bottom panel, end panels foldably joined to the ends of said sidewalls and extending transversely inward therefrom, medial riser panels foldably joined to said end panels respectively, the riser panels at each end of the carrier being secured together in face contacting relation, a medial multi-ply handle connected at its ends to said riser panels, a medial keel panel formed integrally with each riser panel at one end of the carrier and projecting inwardly therefrom, a first transverse partition panel foldably joined to one of said keel panels and arranged with its outer edge anchored to one of said side walls, a second transverse partition panel having its inner edge anchored to the other of said keel panels and its outer edge anchored to the other of said side walls, and a reinforcing tab foldably joined to said other keel panel and disposed in flat face contacting relation with said first transverse partition panel and secured thereto thereby to aid in holding said medial keel panels in close juxtaposition to each other and to prevent outward bowing of said side walls.

2. An article carrier according to claim 1 wherein said first and said second transverse partition panels are disposed in substantial alignment with each other.

3. An article carrier according to claim 1 wherein a plurality of transverse partition panels are foldably joined to said one of said keel panels and arranged with their outer edges anchored to said one of said side walls and wherein a plurality of reinforcing tabs are foldably joined to said other of said medial keel panels and respectively secured in flat face contacting relation to said plurality of transverse partition panels.

4. An article carrier according to claim 1 wherein said reinforcing tab is foldably joined to said other of said keel panels along a substantially vertical fold line.

5. An article carrier according to claim 4 wherein said first transverse partition panel is foldably joined to said one of said keel panels along a substantially vertical fold line disposed in close juxtaposition with said fold line along which said reinforcing tab is foldably joined to said other of said keel panels.

6. An article carrier according to claim 1 wherein said reinforcing tab is struck from said other keel panel.

7. An article carrier according to claim 1 wherein a medial strut panel is foldably joined to the lower edge of said one of said keel panels.

8. An article carrier according to claim 7 wherein the ends of said medial strut panel are interposed between said riser panels at each end of the carrier respectively and secured thereto.

9. An article carrier comprising a bottom panel, opposed side walls foldably joined to opposite side edges of said bottom panel, end panels foldably joined to the ends of said side walls and extending transversely inward therefrom, medial riser panels foldably joined to said end panels respectively, the riser panels at each end of the carrier being secured together in face contacting relation, a medial multi-ply handle connected at its ends to said riser panels, a medial keel panel formed integrally with each riser panel at one end of the carrier and projecting inwardly therefrom, a first transverse partition panel foldably joined to one of said keel panels and arranged with its outer edge anchored to one of said side walls, medial anchoring structure foldably joined to the upper edge of the other of said medial keel panels and projecting downwardly therefrom, a second transverse partition panel foldably joined to said medial anchoring structure and arranged with its outer edge anchored to the other of said side walls, and a reinforcing tab foldably joined to said other keel panel and disposed in flat face contacting relation with said first transverse partition panel and secured thereto thereby to aid in holding said medial keel panels in close juxtaposition to each other and to prevent outward bowing of said side walls.

10. An article carrier according to claim 9 wherein a plurality of transverse partition panels are foldably joined to said first keel panel and arranged with their outer ends anchored to said one side wall and wherein a plurality of transverse partition panels are foldably joined to said medial anchoring structure and arranged with their outer edges anchored to said other side wall and wherein a plurality of reinforcing tabs are foldably joined to said first keel panel and secured to said transverse partition panels which are foldably joined to said first keel panel respectively.

11. An article carrier according to claim 10 wherein a medial strut panel is interposed between said one keel panel and said medial anchoring structure at the lower portions thereof.

12. An article carrier according to claim 10 wherein said medial strut panel is secured in face contacting relation to said medial anchoring structure.

* * * * *